US008591986B1

(12) United States Patent
Ajdelsztajn et al.

(10) Patent No.: US 8,591,986 B1
(45) Date of Patent: Nov. 26, 2013

(54) COLD SPRAY DEPOSITION METHOD

(75) Inventors: Leonardo Ajdelsztajn, Niskayuna, NY (US); James Anthony Ruud, Delmar, NY (US); Timothy Hanlon, Glenmont, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 13/588,499

(22) Filed: Aug. 17, 2012

(51) Int. Cl.

| | |
|---|---|
| ***B05D 1/36*** | (2006.01) |
| ***B05D 3/00*** | (2006.01) |
| ***B05D 7/00*** | (2006.01) |
| ***B05D 1/02*** | (2006.01) |
| ***C23C 4/08*** | (2006.01) |

(52) U.S. Cl.
USPC ..... 427/201; 427/189; 427/190; 427/427; 427/212; 427/456

(58) Field of Classification Search
USPC ..... 427/201, 189–193, 195, 427, 212, 427/214–217, 446, 455, 456; 428/389; 118/308
See application file for complete search history.

(56) References Cited

U.S. PATENT DOCUMENTS

| | | | | |
|---|---|---|---|---|
| 4,008,844 | A * | 2/1977 | Duvall et al. | 228/119 |
| 4,741,973 | A * | 5/1988 | Condit et al. | 428/553 |
| 6,575,349 | B2 | 6/2003 | Van Esch | |
| 6,719,948 | B2 | 4/2004 | Lorenz et al. | |
| 7,360,678 | B2 | 4/2008 | Pietruska et al. | |
| 7,479,299 | B2 * | 1/2009 | Raybould et al. | 427/191 |
| 8,158,704 | B2 | 4/2012 | Jabado et al. | |
| 2005/0003097 | A1 | 1/2005 | Philip et al. | |
| 2007/0031591 | A1 * | 2/2007 | Junker et al. | 427/140 |
| 2007/0215677 | A1 | 9/2007 | Floyd et al. | |
| 2008/0145566 | A1 | 6/2008 | Cretegny et al. | |
| 2010/0055495 | A1 | 3/2010 | Sjodin | |
| 2011/0081480 | A1 | 4/2011 | Bucci et al. | |
| 2012/0051844 | A1 | 3/2012 | Ajdelsztajn | |

FOREIGN PATENT DOCUMENTS

WO 2010136777 * 12/2010

OTHER PUBLICATIONS

Robert C. Tucker., "Thermal Spray Coatings", ASM Handbook, 1994, vol. 5: Surface Engineering, pp. 497-509.
Ajdelsztajn et al.,"Cold Spray of Nickel-Base Alloys", Pending U.S. Appl. No. 13/328,290, filed Dec. 16, 2011, 16 pages.

* cited by examiner

*Primary Examiner* — Timothy Meeks
*Assistant Examiner* — Ann Disarro
(74) *Attorney, Agent, or Firm* — Paul J. DiConza

(57) ABSTRACT

A method of forming a deposit using a cold spray apparatus is disclosed. The method includes introducing a powder feedstock into a cold spray apparatus, and operating the cold spray apparatus to deposit the feedstock. The feedstock includes particles including an interior portion and an outer portion, wherein a melting point of the outer portion is less than a melting point of the interior portion.

18 Claims, 3 Drawing Sheets

COLD SPRAY DEPOSITION METHOD

BACKGROUND

The invention relates generally to cold spray deposition processes, and, in particular, to methods of cold spraying feedstock including coated powder structures.

Bonded surface layers are desired for many applications including those in which the surfaces experience corrosion, erosion, or high temperature. One method used for producing bonded metallic coatings on substrates is cold spray technology. In cold spray technology (also referred to herein as simply "cold spray"), particles are mixed with a gas and the gas and particles are subsequently accelerated into a supersonic jet, while the gas and particles are maintained at a sufficiently low temperature to prevent melting of the particles. Copper coatings have been deposited using cold spray in which sufficient bonding among particles was achieved to produce bulk-like properties. However, higher temperature materials, such as stainless steel, nickel, nickel-base superalloys, and titanium-base alloys, are likely to require higher velocities to produce high quality deposits, challenging the limitations of conventional cold spray devices.

To attain better inter-particle bonding, and hence better deposit properties, using higher melting point metals than copper, a trend in cold spray technology is moving towards the use of higher gas temperatures. However, even high-temperature nitrogen gas is difficult to accelerate to the velocities required to achieve dense deposits of high-melting point materials such as nickel, iron, or titanium alloys. Therefore, helium gas is favored for these applications due to its substantially higher sound speed, relative to nitrogen. However, using helium gas for cold spraying is commercially challenging and in many cases, cost-prohibitive.

Therefore, there is a need for an economical method of making a high-quality bonded deposit of high-melting temperature alloys.

BRIEF DESCRIPTION

Briefly, in one embodiment, a method is disclosed. The method includes introducing a powder feedstock into a cold spray apparatus, and operating the cold spray apparatus to deposit the feedstock. The feedstock includes particles including an interior portion and an outer portion, wherein the melting point of the outer portion is less than the melting point of the interior portion.

In one embodiment, a method is disclosed. The method includes introducing a powder feedstock into a cold-spray apparatus, and operating the cold-spray apparatus to deposit the feedstock. The feedstock consists essentially of particles having a nickel-base alloy core and a shell comprising a nickel-base alloy material along with a melting point-depressant.

DRAWING

These and other features, aspects, and advantages of the present invention will become better understood when the following detailed description is read with reference to the accompanying drawing, wherein.

DETAILED DESCRIPTION

Figure 1:
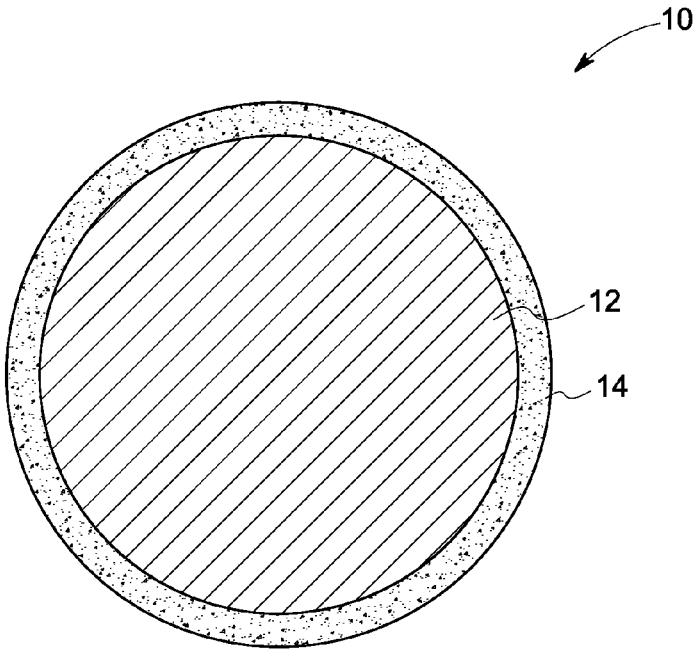
FIG. 1 illustrates coated initial powders of the feedstock, according to an example of the invention.

Embodiments of the present invention include the apparatus and method for producing a dense alloy deposit on a substrate from substantially solid state impact deposition with bonded particles using a cold spray device with nickel-base alloy feedstock.

In the following specification and the claims that follow, the singular forms "a", "an" and "the" include plural referents unless the context clearly dictates otherwise.

The term "bonded", as used herein means in contact with and adhered to. "Bonding" may be between the deposited particles and/or between the deposited particles and the substrate. A "deposit" is a bulk material or layer on a substrate. In a specific embodiment, the deposit is a coating.

Typical cold spray methods use a spray gun that receives a high pressure gas such as, for example, helium, nitrogen, or air, and a feedstock of deposit material, such as, for example, metals, refractory metals, alloys, or composite materials in powder form. The powder granules are introduced at a high pressure into a gas stream in the spray gun and emitted from a nozzle. The particles are accelerated to a high velocity in the gas stream that may reach a supersonic velocity. The gas stream may be heated. Typically the gases are heated to less than the melting point of the particles to minimize in-flight oxidation and phase changes in the deposited material. As a result of the relatively low deposition temperatures and very high velocities, cold spray processes offer the potential for depositing well-adhering, metallurgically bonded, dense, hard and wear-resistant coatings whose purity depends primarily on the purity of the feedstock powder used.

The powder impacts the substrate at a high velocity. The kinetic energy of the powder causes the powder granules to deform and flatten on impact with the substrate. The flattening promotes a metallurgical, mechanical, or combination of metallurgical and mechanical bond with the substrate and results in a deposit on the substrate. One advantage of cold spraying methods is the negligible to nil phase change or oxidation of particles during flight and high adhesion strength of the bonded particles.

In order to have sufficiently high velocities to make dense deposits of higher melting point materials, helium (He) has been employed in the past as a process gas. It has traditionally been used instead of nitrogen ($N_2$) gas for higher melting point materials such as nickel (Ni), iron (Fe), or titanium (Ti) alloys because the sound speed of nitrogen gas is often insufficient to form a dense deposit, when used in the conventional cold spray methodologies. However, spraying with helium is expensive. Embodiments of the present invention take advantage of benefits conferred by characteristics of the feedstock powder that make the powder amenable for cold spraying at less demanding conditions than the conventional helium-based cold spray methods for depositing a coating of high melting point metals and alloys.

Changing some characteristics of the feedstock material, such as the microstructure and/or morphology to reduce particle strength, hardness, or the melting temperature (relative to such characteristics and properties for particles received after typical powder manufacturing processes) may improve fidelity of the deposit by encouraging additional particle deformation, particle-to-particle mechanical bonding, particle-to-substrate mechanical bonding, and/or chemical bonding. Some embodiments of the disclosed method include providing a coating and a heat-treatment of the powder feedstock material that changes the local surface and/or bulk-powder material structure and properties, making the feedstock amenable for cold spraying at economically convenient conditions.

In one embodiment, a method of depositing the feedstock using a cold spray apparatus is presented. The method includes introducing coated powders as a part of the feedstock. Examples of methods that may be used to apply a coating to individual powder particles include chemical vapor deposition, and physical vapor deposition commonly used to coat powder particles, but not limited to, fluidized bed coating, and plasma coating. In one embodiment, as shown in FIG. 1, the coating 14 forms a surface layer on the initial powders 12 of the feedstock, thus forming a coated structure 10. In this embodiment, the coating 14 over the initial powders 12 may be in the form of a distinct layer on the initial powders. In one embodiment, the feedstock includes particles that have initial powder 12 as the interior portion, and coating 14 as the outer portion.

In one embodiment, the coating 14 includes a material that melts at a lower temperature than the initial powder. In one embodiment, the coating 14 includes a melting point-depressant material. As used herein, the "melting point-depressant material" is a material that reduces the melting temperature of the resultant alloy at least by 10 degrees Celsius relative to the alloy without the melting point-depressant material. For example, if a shell is formed over a core material of a nickel-base alloy, the overall melting point of the core-shell structure is reduced below the melting point of that nickel-base alloy at least by 10 degrees Celsius by the introduction of the melting point-depressant material in to the shell. This melting point depression may occur locally at the surface of the particle, or throughout some fraction of the particle diameter, depending on the diffusion gradient of the melting point-depressant into the particle. The melting temperature as defined herein means the incipient melting point of the alloy, wherein a liquid phase begins to appear under equilibrium conditions.

The coating 14 may be formed of a melting point-depressant material, or a compound or composite including the melting point-depressant material. In one embodiment, the melting point-depressant material in the coating 14 is an element. In one embodiment, the coating 14 includes a pre-alloyed material that is rich in a melting point-depressant material. In one embodiment, the coating 14 includes boron, silicon, phosphorous, hafnium, or any combinations of the foregoing as a melting point-depressant element.

In one embodiment, the coated initial powders are introduced into the cold spray apparatus and then subjected to an in-situ heat-treatment. The heat-treatment may aid the diffusion or the diffusion and reaction of the coating material with the initial powder, enabling the melting point-depressant material to diffuse into the powder particle core before cold spraying the feedstock. In one embodiment, the feedstock including the coated powders introduced in to the cold spray apparatus are deposited and then exposed to a temperature of at least one third of the melting point of the melting point-depressant material for duration of at least 5 minutes.

Figure 2:
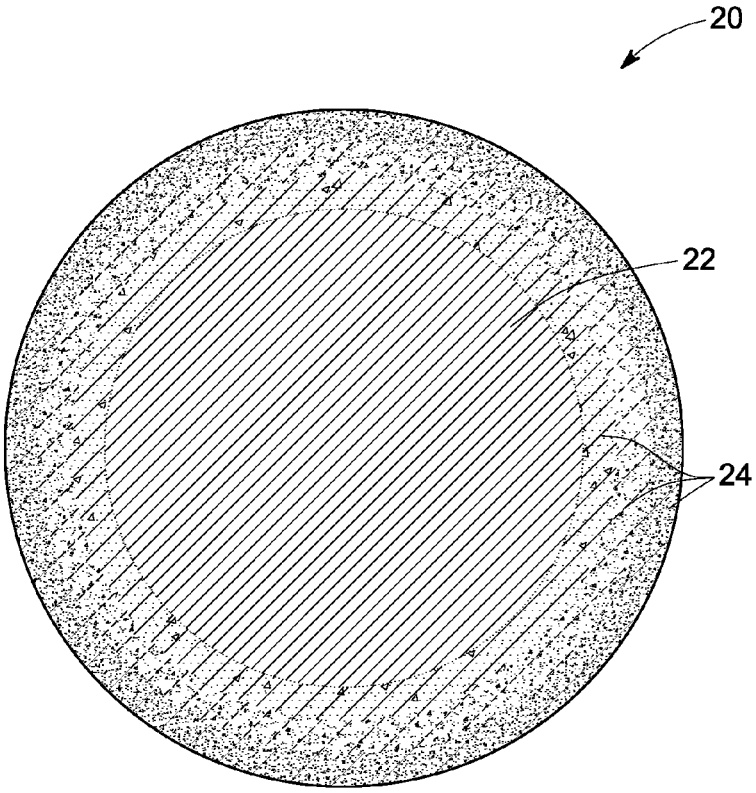
FIG. 2 illustrates a diffused coated structure of the feedstock, according to an example of the invention.

In one embodiment, depending on the heat-treatment conditions, the coating material may diffuse into the initial powders and form a chemical gradient within the initial powder material as shown in FIG. 2, for example.

In one embodiment, the coated structure 10 (FIG. 1) is heat-treated to form a diffused coated structure 20 (FIG. 2) before introducing into a cold spray apparatus. As used herein, individual powder particles may have a radial chemical gradient, or be heat treated so as to eliminate the radial chemical gradient of the melting point-depressant. In the latter, the entire powder particle would have a uniformly reduced melting temperature, relative to an uncoated particle. In the former, melting point suppression would be limited to some fraction of the total powder diameter. The heat-treatment conditions such as temperature and time, for example, may be adjusted to control the diffusion and reaction of the coating material with the initial powder. In one embodiment of the invention, the coated and heat-treated powders are used as at least a part of the feedstock for the cold spray deposition. In one embodiment, the feedstock consists essentially of the powders that have a diffused coated structure. The heat-treatment is normally performed at temperatures sufficiently high to partially diffuse the coating materials 14 into the initial powder 12. The partial diffusion of the coating material into the initial powder may create an interior portion 22 and an outer portion 24 of the heat-treated initial powder.

In one embodiment, the temperature of heat-treatment is typically on the order of about 700° C. to about 1400° C. The heat-treatment duration may be from about 5 minutes to about 1 hour. In one embodiment, this heat-treatment may alter the microstructure of the diffused coated structure.

Thus, in one embodiment, the resultant powder 20 is an as-coated or diffused coated structure, where the material of the outer portion 24 represents the initial coating material, an inter-diffused mixture of the coating material with the initial powder, or an alloy of the coating material with the initial powder. The interior portion 22 of the diffused coated structure 20 may still represent the initial powder chemistry that has further undergone the heat-treatment provided to the powders for the diffusion of the coating material. There may form a concentration gradient of the coating material from the interior portion 22 to the outer portion 24 of the diffused coated structure. Thus, in one embodiment, the diffused coated structure 20 has a higher concentration of the coating material on the surface of the outer portion 24 compared to the concentration of the coating material in the outer portion 24 near the interior portion 22. In this embodiment, the initial powder exposed to a particular heat-treatment may be treated as the interior portion 22 material. The microstructure of the interior portion 22 of the diffused structure 20 may or may not be similar to that of the initial powders. In one embodiment, after the heat-treatment, the interior portion 22 is the heat-treated initial powder and the outer portion 24 is a mixture of the heat-treated initial powder and the heat-treated coating material.

One example of the diffused coated structure 20 is a core-shell powder 20, where the core comprises the interior portion 22, and the shell comprises the outer portion 24. The material comprising the shell may be the initial coating material, an inter-diffused mixture of the coating material with the initial powder, or an alloy of the coating material with the initial powder. In one embodiment, the material of the core may still represent the initial powder chemistry that has further undergone the heat-treatment provided to the powders for the diffusion of the coating material. In one embodiment, there may form a concentration gradient of the coating material from the core to the outside of the core-shell structure. Thus, in this embodiment, the initial powder exposed to a particular heat-treatment may be treated as the core material. The microstructure of the core may or may not be similar to that of the initial powders.

For the sake of simplicity, the diffused coated structure 20 is further explained below with the example of the core-shell structure. In this example, the diffused coated structure 20 is the core-shell structure 20, having a core 22 of the interior portion 22 and a shell 24 of the outer portion 24. However, the denotation of "core-shell structure" does not necessarily limit the powder particles to have an equal radial demarcation between the core and shell parts in all directions. Thus, in one embodiment, the thickness of the shell 24 of a core-shell structure 20 may vary depending on radial direction.

In one embodiment, the core-shell structure 20 formed as presented hereinabove is the feedstock for the cold spray of the required deposit. As used herein, the "feedstock" is the powder that is introduced into the cold spray apparatus for any cold spray deposit. In one embodiment, the particles of the feedstock have a median particle size in the range from about 1 μm to 100 μm. In one embodiment, the median particle size is in the range from about 10 μm to 50 μm.

In this embodiment, the disclosed method is different from an in-situ or inside-the-spray gun heat-treatment of the feedstock material during or just before spraying the feedstock. The feedstock material used herein receives its heat-treatment and thus changes one or more characteristics, such as, for example, its composition, melting point, microstructure, morphology, strength, or hardness, even before introduction into the cold spray apparatus. Further, the heat-treatment that is received by the feedstock material in this embodiment is different from what can be applied inside a spray gun apparatus. Prior disclosures of inside-the-spray-gun heat-treatments of the feedstock material are limited in the temperature and time duration of high-temperature treatment of the feedstock material and thereby the composition, microstructure, morphology, and strength/hardness when compared to the heat-treated particles of the present application.

In one embodiment of the method presented herein, the core 22 of the feedstock material includes a metal, or a metal alloy. Examples include metals such as nickel, cobalt, titanium, aluminum, zirconium, and copper. Examples of metal alloys include nickel-base alloys, cobalt-base alloys, titanium-base alloys, iron-base alloys, steels, stainless steels, and aluminum-base alloys. In one particular embodiment, the feedstock material comprises nickel-base superalloys.

Some of the nickel, iron, cobalt, or titanium-base alloys are used in aviation- and land-based gas turbine engine components and are particularly desirable to be cold spray deposited to form a dense coating without undue oxidation. Alloys, such as the so-called "superalloys" commercially available under such trade names as INCONEL®, INCOLOY®, RENE®, WASPALOY®, UDIMET®, Hastelloy®, Haynes®, Nimonic®, Stellite®, and Mar-M™ materials are some of the non-limiting examples that are particularly beneficial to be used for the engine components. Stainless steels such as 300 series steels, 400 series steels, 17-4PH, and 15-5PH are some of the non-limiting iron-base alloy examples. Alloys such as CP Ti, Ti64, Ti6242, titanium aluminides are some of the non-limiting titanium-base alloys. While different feedstock and deposit materials are included in the invention, the application herein is further described in terms of nickel-base alloys as the feedstock material as well as deposit material. In one particular example, the nickel alloy has at least 40 Wt % of nickel. In one embodiment, the iron alloy has at least about 40 Wt % of iron. In one embodiment, the cobalt alloy has at least about 40 Wt % of cobalt, and in another embodiment, the titanium alloy has at least 70 Wt % of titanium.

In one embodiment, the core 22 of the feedstock consists essentially of particles comprising at least about 40% nickel by weight. In one embodiment, the core-shell structure of the feedstock includes a nickel base alloy at the core of the core-shell structure. A non-limiting example of a nickel-base alloy is alloy 718, having a specific composition, in weight percent, from about 50 to about 55 percent nickel, from about 17 to about 21 percent chromium, from about 4.75 to about 5.50 percent niobium, from about 2.8 to about 3.3 percent molybdenum, from about 0.65 to about 1.15 percent titanium, from about 0.20 to about 0.80 percent aluminum, 1.0 percent maximum cobalt, and balance iron. Small amounts of other elements such as carbon, manganese, silicon, phosphorus, sulfur, boron, copper, lead, bismuth, and selenium may also be present.

Figure 4:
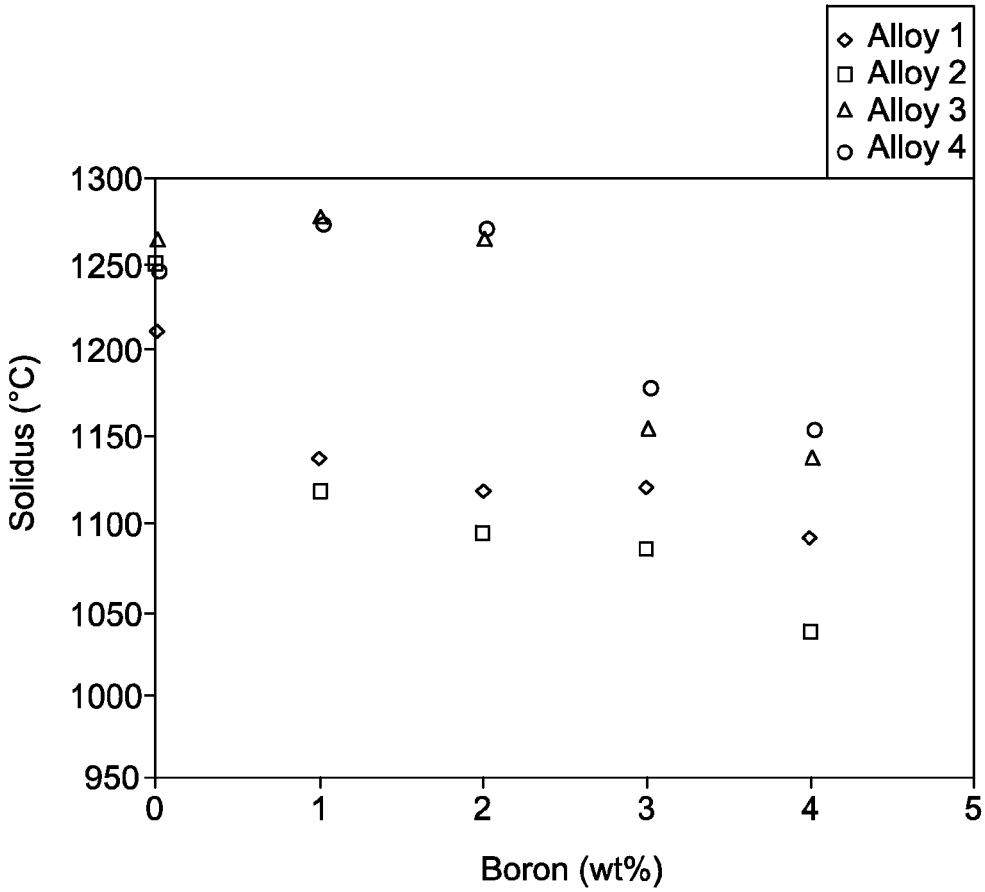
FIG. 4 illustrates calculated melting point depressions in some alloys, predicted using the phase equilibria tool ThermoCalc™, in accordance with an Example.

In one embodiment, the melting point-depressant material lowers the melting point of the particle at the surface by greater than about 25 degrees Celsius. In one embodiment, the melting point of the particle at the surface is reduced by more than about 50 degrees Celsius. For example, FIG. 4 illustrates the Thermocalc™ calculated incipient melting points of several generic nickel-base alloys as a function of boron concentration. The graph shows the magnitude of the melting point depression of these alloys by way of boron addition. For example, an addition of 3 Wt % and 4 Wt % of boron to all the illustrated nickel-base alloys show significant (more than 50 degrees Celcius) decrease in their melting points.

In one embodiment, the shell 24 of the core-shell structure 20 includes a melting point-depressant material. The shell 24 of the core-shell structure 20 may be formed of a melting point-depressant material, or a compound or composite including the melting point-depressant material. In one embodiment, the melting point-depressant material is an element. In one embodiment, the shell of the core-shell structure includes boron, silicon, phosphorous, hafnium, or any combinations of the foregoing as a melting point-depressant element. In one embodiment, the shell of the core-shell structure includes nickel and boron. In one embodiment, the melting point-depressant material present in the shell is less than about 5 Wt % of the overall feedstock particle composition. In one embodiment, the melting point-depressant material present in the shell is in a range from about 0.02 Wt to about 2 Wt % of the overall feedstock particle composition. In one embodiment, the melting point-depressant material has a concentration gradient in the core-shell structure. The concentration gradient is such that the concentration of the melting point-depressant material increases from the core to the outer surface of the shell. In one embodiment, the shell includes a boron-rich nickel base alloy as an outermost surface of the feedstock powder. As used herein, a boron-rich nickel base alloy means that the percentage of boron in the nickel base alloy is greater than about 0.1 Wt %. In one embodiment, the composition of the shell is similar or identical to that of the core, with the exception of having an increased boron level relative to that in the core.

The coated nickel-base powders are typically thermally processed using heat-treatment methods that allow for optimum diffusion of the melting point-depressant element or alloy. The heating rate, heating path, cooling rate, and cooling path imposed on melting point-depressant-coated nickel-base alloy components, along with the aging temperature and times, and inherent properties of the particular compositions influence the formation of the optimum core-shell structure.

In one embodiment of the invention, the heat-treatment of the coated nickel-base alloy is normally performed at temperatures sufficiently high to partially diffuse the melting point-depressant material or materials in to the initial powder region, typically on the order of 900° C. to 1300° C. for a duration of 5 minutes to 1 hour. This heat-treatment may alter the microstructure of the coated nickel-base alloy and the resultant core-shell structures typically have a concentration gradient of the melting point-depressant material in the shell part of the core-shell material. In one example, boron is used as the melting point-depressant material for nickel-base alloy particles and the boron coated nickel-base alloy particles are subjected to the heat-treatments within the above mentioned temperature and time duration.

In one embodiment, the core-shell structure of the nickel-base alloy powders results in the feedstock material being softer at the outer surface than the inner core, thus making the feedstock more amenable for cold spraying at reduced temperature and/or spray velocities as compared to the initial uncoated powders. In one embodiment, a higher concentration of melting point-depressant material at the outer portion than at the core results in a reduction of the homologous temperature (i.e., fraction of the material's melting point) at the outer portion of the particle. Generally strength and hardness varies inversely with homologous temperature, and thus the outer portion is generally softer at a given temperature than the core material.

In one embodiment of the invention, a method for preparing an article made of a nickel-base alloy deposit is disclosed. The method includes fabricating a feedstock of the core-shell powder including the core of a nickel-base alloy and a shell of reduced melting temperature, and cold spraying the core-shell feedstock on a substrate.

As discussed previously, in one embodiment of the cold spray method presented herein, the feedstock material does not melt at the time of spraying. In one embodiment, the melting point of the feedstock material is above the temperature attained by the feedstock material during spraying. In a further embodiment, the temperature attained by the feedstock material is below about 0.9 times the melting point of the feedstock material. In one embodiment, the feedstock material is substantially solid state at the time of deposition.

In one embodiment of the invention, a process gas is used for carrying the feedstock material during deposition. Because of the change in composition, microstructure and decreased melting temperature, strength, and hardness of the core-shell nickel-base alloy powder feedstock, the operator is not limited to the use of helium gas to obtain a dense nickel-base alloy deposit on the article. Therefore, in one embodiment of the invention, a process gas having at least 50 volume % of nitrogen is used during cold spray. In one embodiment, the process gas includes at least 75 volume % of nitrogen. In one embodiment, the process gas consists essentially of nitrogen. In one embodiment, the process gas used for deposition is essentially free of helium. In one embodiment, the process gas temperature is in the range from about 500° C. to about 1200° C. In general, in the cold spray process, an impact critical velocity of the feedstock material is defined as that below which the particle adhesion to the substrate is not useful for the intended application. The critical velocity of the feedstock material may depend on the properties of the feedstock particles and the substrate. In one embodiment, operating the cold spray device used herein comprises accelerating the feedstock to a velocity in the range from about 500 m/s to about 1100 m/s.

In one embodiment, the article on which the deposit is formed is prepared for receiving the deposit. Preparing the article surface for cold spray may include cleaning and/or degreasing the surface. In one embodiment, a prepared region of the article surface is formed by removing the existing material or layer such as an oxide layer for example, from the surface of the article so that the deposit formed by directing the feedstock material through the cold spray apparatus is bonded to the article.

Figure 3:
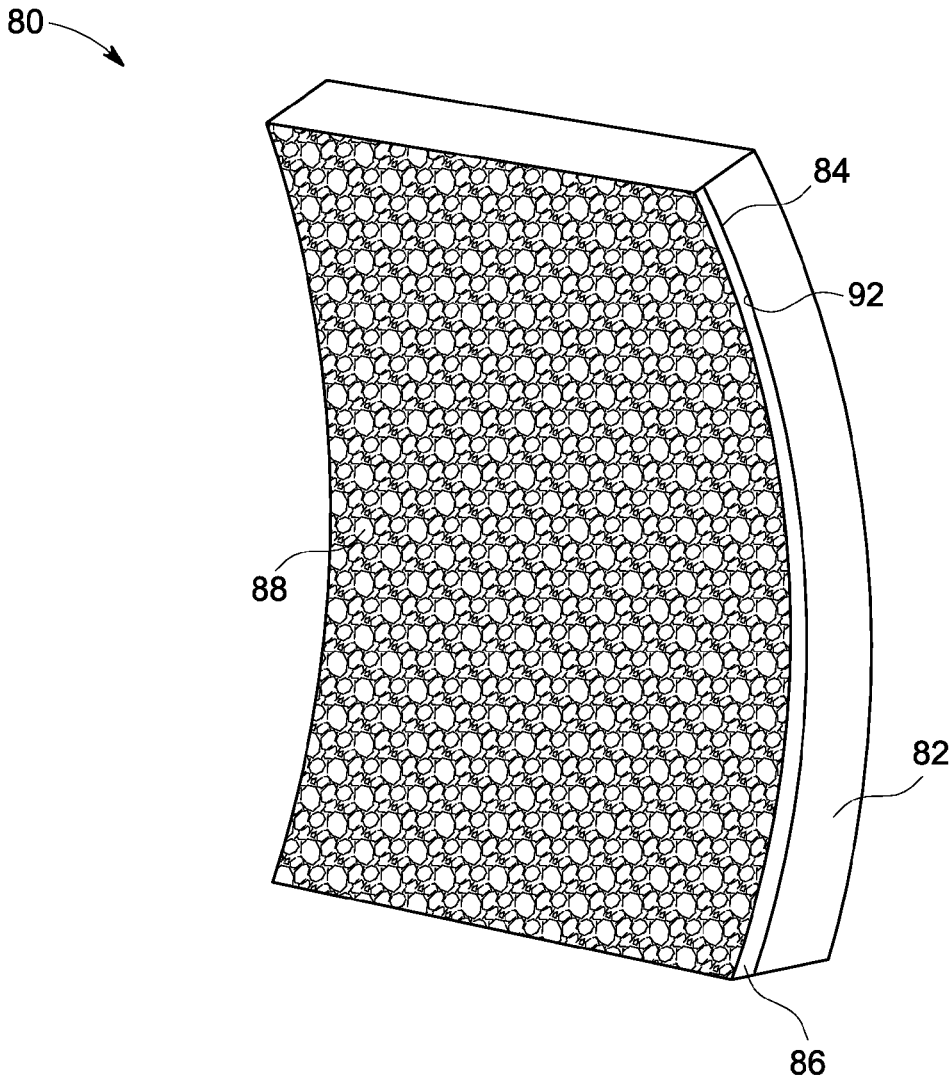
FIG. 3 illustrates an article with a deposit, according to an embodiment of the invention.

In one embodiment of the invention, an article is provided. The article may be of any operable shape, size, and configuration. Examples of articles of interest include areas of gas turbine engines such as seals and flanges, as well other types of articles. The article 80, as shown in FIG. 3 for example, is formed when a deposit is formed on a substrate 82 of the article 80. The substrate 82 has a depositing surface 84. The deposit 86 is formed on the surface 84 of article 80. The deposit 86 has a plurality of feedstock particles 88. A surface of contact between the deposited material 86 and the substrate 82 surface 84 is a bond line 92. In one embodiment, the melting point-depressant material has further diffused into the core region during the cold spray process, or during a post-deposit heat-treatment of the article. In one embodiment, the deposit 86 has a substantially uniform distribution of the melting point-depressant material.

In one embodiment, the article 80 and/or the deposit 86 are heat-treated after the cold spray process. In one embodiment, the temperature of the post-deposit heat treatment is in the range from about 300° C. to about 1400° C. In one embodiment, the temperature of the post-deposit heat-treatment is in the range of about 400° C. to about 1000° C.

In one embodiment, the heat-treatment may cause the deposit material 86 to inter diffuse to some degree with the substrate 82 material of the article 80. In one embodiment, the deposit 86 of article 80 has a density greater than about 95% of theoretical density of the feedstock. In a further embodiment, the deposit 86 has a density greater than about 99% of theoretical density.

In one embodiment, a post-deposit heat treatment results in transient liquid phase bonding of particle-to-particle boundaries and/or particle-to-substrate interfaces as a result of the high remnant concentration of the melting point-depressant at the outer diameter of the deposited powder feedstock. In this embodiment, near 100% theoretical density may be achieved by using the above-mentioned cold spray method and post-deposit heat treatments.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method, comprising:

introducing a powder feedstock into a cold spray apparatus, wherein the feedstock comprises particles comprising an interior portion and an outer portion, wherein the interior portion comprises a nickel-base alloy, and the outer portion comprises a nickel-base alloy and a melting point-depressant material; and operating the cold spray apparatus to deposit the feedstock on a substrate.

2. The method of claim 1, wherein the melting point-depressant material comprises boron, silicon, phosphorous, hafnium, or any combinations of the foregoing.

3. The method of claim 2, wherein the melting point-depressant material comprises boron.

4. The method of claim 1, wherein the melting point-depressant material is less than 5 Wt % of the particles.

5. The method of claim 4, wherein the melting point-depressant material is in a range from 0.02 Wt % to 2 Wt % of the particles.

6. The method of claim 1, wherein the particles comprise a core-shell structure, the structure comprising:

(i) a core comprising the interior portion, and (ii) a shell comprising the outer portion disposed on the core.

7. The method of claim 6, wherein the particles comprise a concentration gradient of the melting point-depressant material from the core to an outer surface of the shell.

8. The method of claim 7, wherein the concentration of the melting point-depressant material increases from the core to the outer surface of the shell.

9. The method of claim 1, further comprising exposing the powder feedstock to a temperature greater than the melting point of the melting point-depressant material during the operation of the cold spray apparatus.

10. The method of claim 1, wherein the particles have a median particle size in the range from 1 μm to 100 μm.

11. The method of claim 1, further comprising exposing the powder feedstock to a temperature of at least one third of the melting point of the interior portion material during the operation of the cold spray apparatus.

12. The method of claim 1, wherein operating the cold spray apparatus further comprises introducing a process gas comprising nitrogen into the apparatus.

13. The method of claim 12, wherein the process gas temperature is in the range from 400° C. to 1200° C.

14. The method of claim 1, further comprising heat-treating the deposited feedstock.

15. The method of claim 14 wherein the heating step further comprises particle-to-particle and particle-to-substrate transient liquid phase bonding.

16. The method of claim 1, wherein operating the cold spray device comprises accelerating the feedstock to a velocity in the range from 500 m/s to 1200 m/s.

17. A method comprising:

introducing a powder feedstock into a cold spray apparatus, wherein the feedstock consists essentially of particles having a nickel-base alloy core and a shell comprising a nickel-base alloy and a melting point-depressant material; and operating the cold spray apparatus to deposit the feedstock on a substrate.

18. The method of claim 17, wherein the melting point-depressant material comprises boron.

* * * * *